United States Patent [19]

Danna et al.

[11] Patent Number: 4,988,138

[45] Date of Patent: Jan. 29, 1991

[54] BUMPER GUARD FOR BABY WALKER

[75] Inventors: Jori L. Danna, St. Paul; Mary M. Bauer, Woodbury, both of Minn.

[73] Assignee: Baby Bumpers, Inc., St. Paul, Minn.

[21] Appl. No.: 502,062

[22] Filed: Mar. 29, 1990

[51] Int. Cl.[5] ..... B60R 19/42

[52] U.S. Cl. ..... 293/127; 293/109; 293/120; 280/87.051

[58] Field of Search ..... 293/127, 109, 120, 142; 272/70.3; 280/87.051

[56] References Cited

U.S. PATENT DOCUMENTS

| | | | |
|---|---|---|---|
| 1,357,043 | 10/1920 | Gordon . | |
| 2,235,598 | 3/1941 | Wisecarver | 155/22 |
| 3,183,028 | 5/1965 | Williams | 293/62 |
| 3,796,430 | 3/1974 | Sudo | 272/70.3 |
| 3,884,495 | 5/1975 | Petock | 272/70.3 X |
| 4,171,132 | 10/1979 | Kassai | 272/70.3 |
| 4,405,045 | 8/1977 | Boucher et al. | 280/87.051 |

FOREIGN PATENT DOCUMENTS

| | | | |
|---|---|---|---|
| 144537 | 1/1952 | Australia | 280/87.051 |

*Primary Examiner*—Margaret A. Focarino
*Assistant Examiner*—Gary C. Hoge
*Attorney, Agent, or Firm*—Kinney & Lange

[57] ABSTRACT

A detachable bumper guard is provided for use with a baby walker, the baby walker includes a lower circular base having an outer perimetrical surface and wheel mechanisms attached to the ower circular base. The bumper guard comprises a longitudinal cushioning main body sufficient in length to substantially encircle the perimentrical surface and a slot disposed longitudinally in the main body adapted to receive at least a portion of the outer perimetrical surface. Also provided is a mechanism for releasably attaching the main body to the lower circular base such that the perimetrical surface is in receiving relationship with the slot and the main body substantially encircles the perimetrical surface when the main body is attached to the lower circular base.

14 Claims, 2 Drawing Sheets

BUMPER GUARD FOR BABY WALKER

BACKGROUND OF THE INVENTION

The present invention relates to baby walkers, and in particular, it relates to bumper guards for baby walkers.

The use of baby walkers which allow an infant to exercise by walking by himself or herself is well known. Baby walkers are considered convenient and beneficial training exercises for the infant. However, in use the baby walker can strike a person's ankle, furniture, and walls and occasionally causes a nick or scrape on the furniture or wall.

Patents that describe baby walkers include Kassai U.S. Pat. No. 4,171,132 and Sudo U.S. Pat. No. 3,796,430. The Kassai patent describes an infant walking trainer which can be collapsed and folded for easier storage and transport. The infant walking trainer is collapsible upon activation of release mechanisms located on the legs of the walking trainer. The Sudo patent describes a baby walker having foldable legs, whereby the walker may be collapsed into a substantially flat form for shipping or transportation. A plastic covering is provided for covering the leg joints to prevent injury to the infant or damage to furniture. This covering is movable downwardly along the legs to expose the joints when the legs are folded up.

The use of bumpers for baby walkers is described in U.S. Pat. No. 3,183,028 by Williams. The Williams patent describes a bumper encircling the baby walker at a level relatively close to the floor. The brackets are mounted or secured to the lowermost portion of each of the legs of the baby walker. The bumper is then mounted on the brackets thereby releasably securing the bumper to the brackets.

SUMMARY OF THE INVENTION

The present invention includes a detachable bumper guard for use with a baby walker. The baby walker includes a lower circular base having an outer perimetrical surface and wheel mechanisms attached to the lower circular base. The bumper guard comprises a longitudinal cushioning main body sufficient in length to substantially encircle the perimetrical surface and a slot disposed longitudinally in the main body adapted to receive at least a portion of the outer perimetrical surface. Also provided is a mechanism for releasably attaching the main body to the lower circular base such that the perimetrical surface is in receiving relationship with the slot and the main body substantially encircles the perimetrical surface when the main body is attached to the lower circular base.

DETAILED DESCRIPTION OF THE PREFERRED EMBODIMENTS

Figure 1:
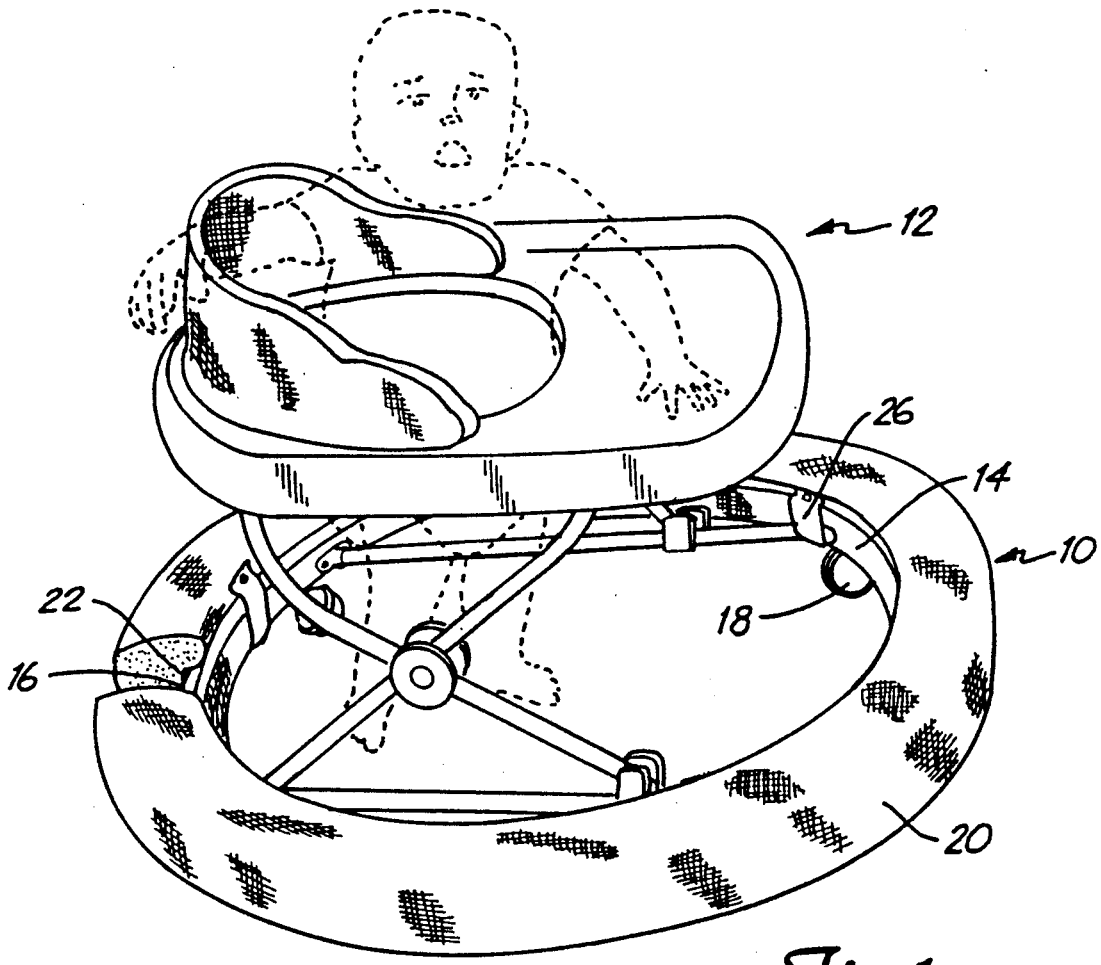
FIG. 1 is a perspective view of the baby walker bumper guard of the present invention encircling the lower circular base of the baby walker.

A bumper guard of the present invention is generally indicated at 10 in FIG. 1. The bumper guard is generally for use with a baby walker, designated generally at 12. The baby walker 12 includes a lower circular base 14 having an outer perimetrical surface 16 and wheels 18 attached to the lower circular base 14 by wheel shafts 19.

The bumper guard 10 includes a longitudinal cushioned main body 20 sufficient in length to substantially encircle the perimetrical surface 16. As best illustrated in Figure the main body 20 substantially encircles the perimetrical surface 16.

In a preferred embodiment, the cushioned main body 20 is formed of a resilient foam material, the foam material is flexible and elastic such that the material maintains its original shape after having been deformed or distorted due to hitting a wall or furniture. Other conventional material which is suitable for use as the cushioned main body 20 may be used. Material which is completely or partly hollowed, may also be utilized for the cushioned main body 20. In addition, the cushioned main body 20 is preferably a continuous foam material piece. However, sectioned, segmented, or portioned material may also be used.

Figure 2:
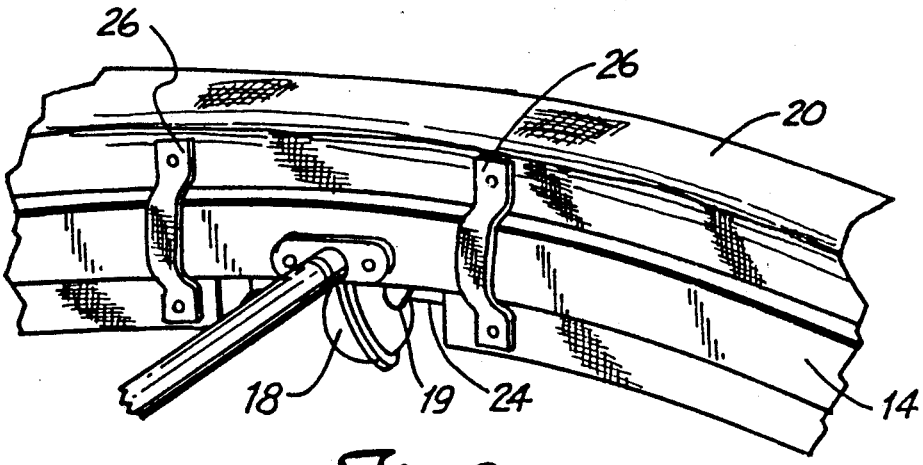
FIG. 2 is a perspective view of the mechanism for releasably attaching the main body to the lower circular base in an attached manner.
Figure 3:
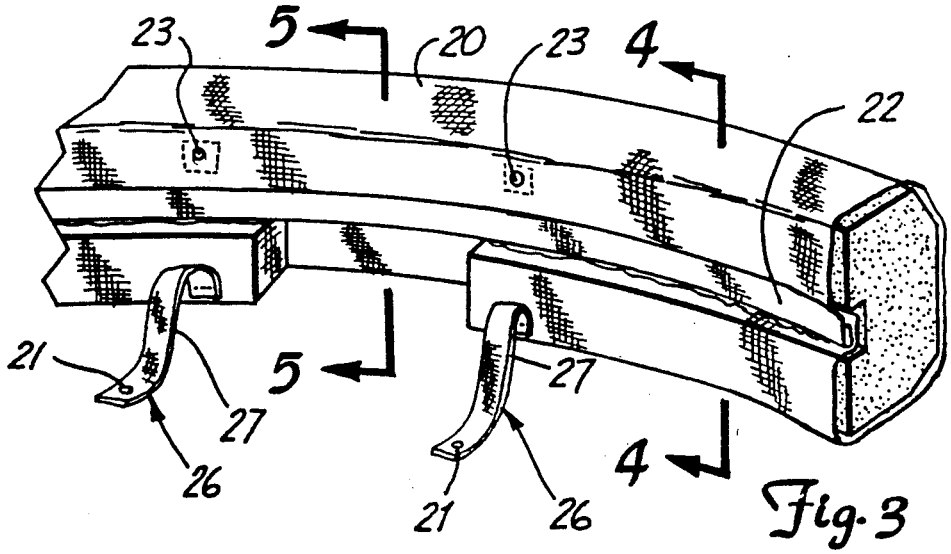
FIG. 3 is a perspective view of the mechanism for releasably attaching the main body to the lower circular base being in an unattached manner.
Figure 4:
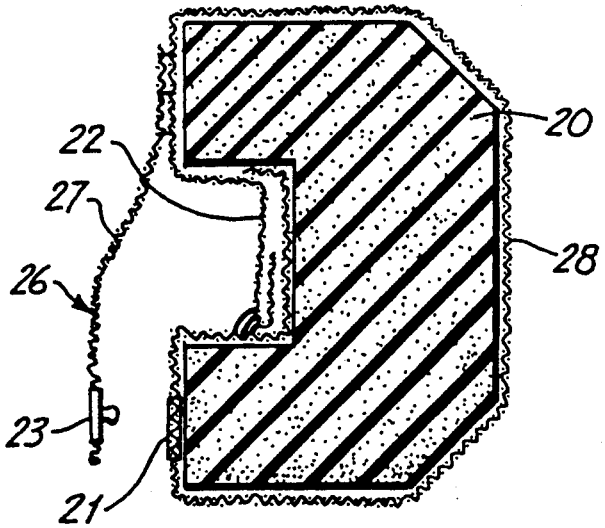
FIG. 4 is a sectional view taken along the line 4—4 in FIG. 3.
Figure 5:
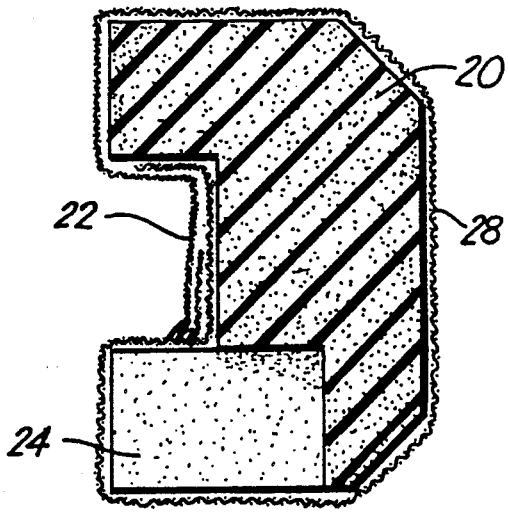
FIG. 5 is a sectional view taken along the line 5—5 in FIG. 3.

A slot 22, as illustrated in FIGS. 3, 4 and 5, is disposed longitudinally in the main body 20 and is adapted to receive at least a portion of the outer perimetrical surface 16. Preferably, the slot 22 is longitudinally disposed substantially in the center of the main body 20 as illustrated in FIG. 2. In addition, the slot 22 preferably extends the entire longitudinal length of the main body 20 in order to substantially receive the entire portion of the outer perimetrical surface 16.

Referring to FIGS. 2 and 3, the bumper guard 10 further may include a plurality of recessed areas 24 disposed in the main body 20. Each of the recessed areas 24 are adapted to fit over at least a portion of the wheels 18 and wheel shafts 19. Preferably, each recessed area 24 is positioned about the main body 20 and is substantially equidistant from adjacent recessed areas 24. Other embodiments, including recessed areas 24 which are not equidistant from each adjacent recessed area 24, may be utilized to correspond to the placement of wheels 18 about the lower circular base 14.

Referring now to FIGS. 2, 3 and 4, a mechanism 26 for releasably attaching the main body 20 to the lower circular base 14 is provided. The main body 20 is attached to the lower circular base 14 such that the perimetrical surface 16 is in receiving relationship with the slot 22. The main body 20 preferably substantially encircles the perimetrical surface 16 when the main body 20 is attached to the lower circular base 14.

The mechanism 26 for releasably attaching the main body 20 to the lower circular base 14 includes snap fasteners 26 having a female member 21 and a male member 23, as best illustrated in FIG. 3. The female member 21 of the snap 26 is preferably attached to the end of a flexible strap or belt member 27 while the male member 23 is preferably attached to the cushioned main body 20 on opposite sides of the slot 22. The strap 27 is secured to the main body 20 on the end opposite the female member 21 in a conventional manner such that the strap 27 extends over the lower circular base 14 when the perimetrical surface 16 is in receiving relationship with the slot 22. After the strap 27 is extended over the lower circular base, the female member 21 is mated with the male member 23 such that the cushioned main body 20 is securely held to the lower circular base 14 as best illustrated in FIG. 2. The snap fasteners 26 also may include, for example, buttons, hook and loop fasteners or buckles, although any type of fastening mechanism may be used as the fastener 26.

The snap fasteners 26 are preferably disposed on either side of each of the recessed areas 24. By disposing the snap fasteners 26 in this manner, the snaps 26 will be located on each side of the wheels 18 when the perimetrical surface 16 is in receiving relationship with the slot 22 thereby reducing the movement of the cushioned main body 20 relative to the lower circular base. The snap fasteners 26 may be disposed on other areas of the cushioned main body 20 including being located equidistant between each adjacent recessed area 24 and staggered about the main body 20. However, any location on the cushioned main body 20 may be used for the location of the snap fasteners 26.

The number of the snap fasteners 26 preferably correspond to the number of recessed areas 24 disposed in the cushioned main body 20. For example, if the snap fasteners 26 are disposed on either side of each of the recessed areas 24, then the number of snap fasteners 26 will be double the number of the recessed areas 24. However, any number of the snap fasteners 26 may be utilized in attaching the cushioned main body 20 to the lower circular base 14.

The bumper guard 10 preferably includes a cover material 28 as illustrated in FIGS. 4 and 5. In the preferred embodiment, the cover material 28 is fabricated from cloth fabric or other textile material. The cover material 28 may also be fabricated from plastic or other materials which may be easily washed or cleaned when needed. It is desirable that the cover material be nontoxic due to the use of the bumper guard 10 in close proximity to infants and other small children. In addition, the cover material 28 preferably has childrens' designs or other markings to make the cover material 28 more aesthetically pleasing to both children and adults. However, a cover material 28 without such designs or markings is within the spirit and scope of the present invention.

The cover 28 is preferably substantially shaped to fit snugly around the main body 20. To achieve this result, the recessed areas 24 and the slot 22 are sewn or formed in the cover material 28. The snug fit allows the slot 22 and the recessed areas 26 to be freely open to receive the perimetrical surface 16 and the wheels 18, respectively.

In the specific embodiment, illustrated in FIG. 4, the snap fasteners 26 for releasably attaching the main body 20 to the lower circular base 14, as described in detail above, are disposed on cover 28. By disposing the snap fasteners on the cover material 28, the bumper guard 10 is easily removable for cleaning or other servicing needs.

Although the present invention has been described with reference to preferred embodiments, workers skilled in the art will recognize that changes may be made in form and detail without departing from the spirit and scope of the invention.

What is claimed is:

1. A detachable bumper guard for use with a baby walker, the baby walker including a lower circular base having an outer perimetrical surface and wheels attached to the lower circular base by wheel shafts, the guard comprising:

a longitudinal cushioning main body sufficient in length to substantially encircle the perimetrical surface;

a slot disposed longitudinally in the main body adapted to receive at least a portion of the outer perimetrical surface; and means for releasably attaching the main body to the lower circular base such that the perimetrical surface is in receiving relationship with the slot and the main body substantially encircles the perimetrical surface when the main body is attached to the lower circular base.

2. The bumper guard of claim wherein the cushioned main body is formed of a resilient foam material.

3. The bumper guard of claim 1 wherein the cushioned main body is solid.

4. The bumper guard of claim 1 wherein the cushioned main body is continuous.

5. The bumper guard of claim 1 wherein the slot receives the entire portion of the outer perimetrical surface.

6. The bumper guard of claim 1 wherein the slot is longitudinally disposed substantially in the center of the main body.

7. The bumper guard of claim 1 wherein a plurality of recessed areas are disposed in the main body, each of the recessed areas adapted to fit over at least a portion of the wheels.

8. The bumper guard of claim 7 wherein each recessed area is positioned about the main body and is substantially equidistant from each adjacent recessed area.

9. The bumper guard of claim 7 wherein the means for releasably attaching the main body to the lower circular base includes snap fasteners.

10. The bumper guard of claim 9 wherein the fasteners are disposed on either side of each of the recessed areas.

11. The bumper guard of claim 1 wherein the bumper quard further includes a cover material, the cover material being substantially shaped to fit snugly around the main body.

12. The bumper guard of claim 11 wherein the cover material is comprised of cloth fabric.

13. The bumper guard of claim 11 wherein the means for releasably attaching the main body to the lower circular base is disposed on the cover.

14. The bumper guard of claim 13 wherein the means for releasably attaching the main body to the lower circular base includes snap fasteners.

* * * * *

UNITED STATES PATENT AND TRADEMARK OFFICE

CERTIFICATE OF CORRECTION

PATENT NO. : 4,988,138

DATED : January 29, 1991

INVENTOR(S) : Jori L. Danna et al.

It is certified that error appears in the above-identified patent and that said Letters Patent is hereby corrected as shown below:

Col. 4, line 22, delete "claim", insert --claim 1--.

Signed and Sealed this

Ninth Day of June, 1992

*Attest:*

DOUGLAS B. COMER

*Attesting Officer*

*Acting Commissioner of Patents and Trademarks*